US007270097B2

(12) United States Patent
Purcilly et al.

(10) Patent No.: US 7,270,097 B2
(45) Date of Patent: Sep. 18, 2007

(54) CAMSHAFT DRIVE SYSTEM AND ENGINE ASSEMBLY

(75) Inventors: Gregg T. Purcilly, Troy, MI (US); Franz Decarli, Garden City, MI (US); Chris Cowland, Dexter, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 0 days.

(21) Appl. No.: 11/391,173

(22) Filed: Nov. 21, 2005

(65) Prior Publication Data

US 2007/0056544 A1 Mar. 15, 2007

Related U.S. Application Data

(60) Provisional application No. 60/716,593, filed on Sep. 13, 2005.

(51) Int. Cl.
*F01L 1/02* (2006.01)

(52) U.S. Cl. ..... 123/90.31; 123/90.6; 123/90.27

(58) Field of Classification Search ..... 123/90.31, 123/90.6, 196 R, 90.27
See application file for complete search history.

(56) References Cited

U.S. PATENT DOCUMENTS 5,873,336 A * 2/1999 Uchida ..... 123/90.31

* cited by examiner

*Primary Examiner*—Thomas Denion
*Assistant Examiner*—Zelalem Eshete

(57) ABSTRACT

An engine assembly is provided including an engine crankshaft and a balance shaft connected with the crankshaft and rotatably driven thereby. A vehicle component such as a hydraulic pump or an overhead camshaft is operatively connected with the balance shaft such that it is rotatably driven by the crankshaft through the balance shaft. A camshaft drive system includes the engine crankshaft, the balance shaft and the overhead camshaft.

13 Claims, 4 Drawing Sheets

CAMSHAFT DRIVE SYSTEM AND ENGINE ASSEMBLY

CROSS-REFERENCE TO RELATED APPLICATIONS

This application claims the benefit of U.S. Provisional Application No. 60/716,593, filed Sep. 13, 2005, which is hereby incorporated by reference in its entirety.

TECHNICAL FIELD

This invention relates to an engine assembly; specifically, the invention relates to a camshaft drive system.

BACKGROUND OF THE INVENTION

In addition to propelling a vehicle, power from an engine crankshaft may be used to drive one or more vehicle components or systems, such as an engine lubrication oil pump or an overhead camshaft. For example, a crankshaft is typically connected to a camshaft via a gear drive or by a pair of sprockets with a belt or chain interconnecting the sprockets. As used herein, a "gear drive" is a set of one or more intermeshing gears.

SUMMARY OF THE INVENTION

An engine assembly is provided having a balance shaft that rotatably drives one or more vehicle components by utilizing the existing driving connection between the balance shaft and the crankshaft. The engine assembly includes an engine crankshaft operatively connected with the balance shaft such that it drives the balance shaft. A vehicle component such as a pump or an overhead camshaft is operatively connected with the balance shaft such that it is rotatably driven by the crankshaft through the balance shaft. Preferably, the balance shaft is operatively connected with the crankshaft at one end, e.g., by intermeshing gears or a sprocket and chain arrangement, and is operatively connected with the driven vehicle component at an opposing end. Thus, by utilizing the existing gear drive between the crankshaft and the balance shaft in the drive train for the vehicle component, packaging space at the end of the crankshaft nearer the vehicle component is left available for other uses. Other components may form part of the drive train as well. For instance, an idler sprocket assembly may be rotatably powered by the balance shaft such that the vehicle component is operatively connected with the balance shaft via the idler sprocket assembly.

Accordingly, a camshaft drive system includes an engine crankshaft and a balance shaft operatively connected with the crankshaft and rotatably driven thereby. An overhead camshaft is operatively connected with the balance shaft such that it is rotatably driven by the crankshaft through the balance shaft.

The above features and advantages and other features and advantages of the present invention are readily apparent from the following detailed description of the best mode for carrying out the invention when taken in connection with the accompanying drawings.

DESCRIPTION OF THE PREFERRED EMBODIMENT

Figure 1:
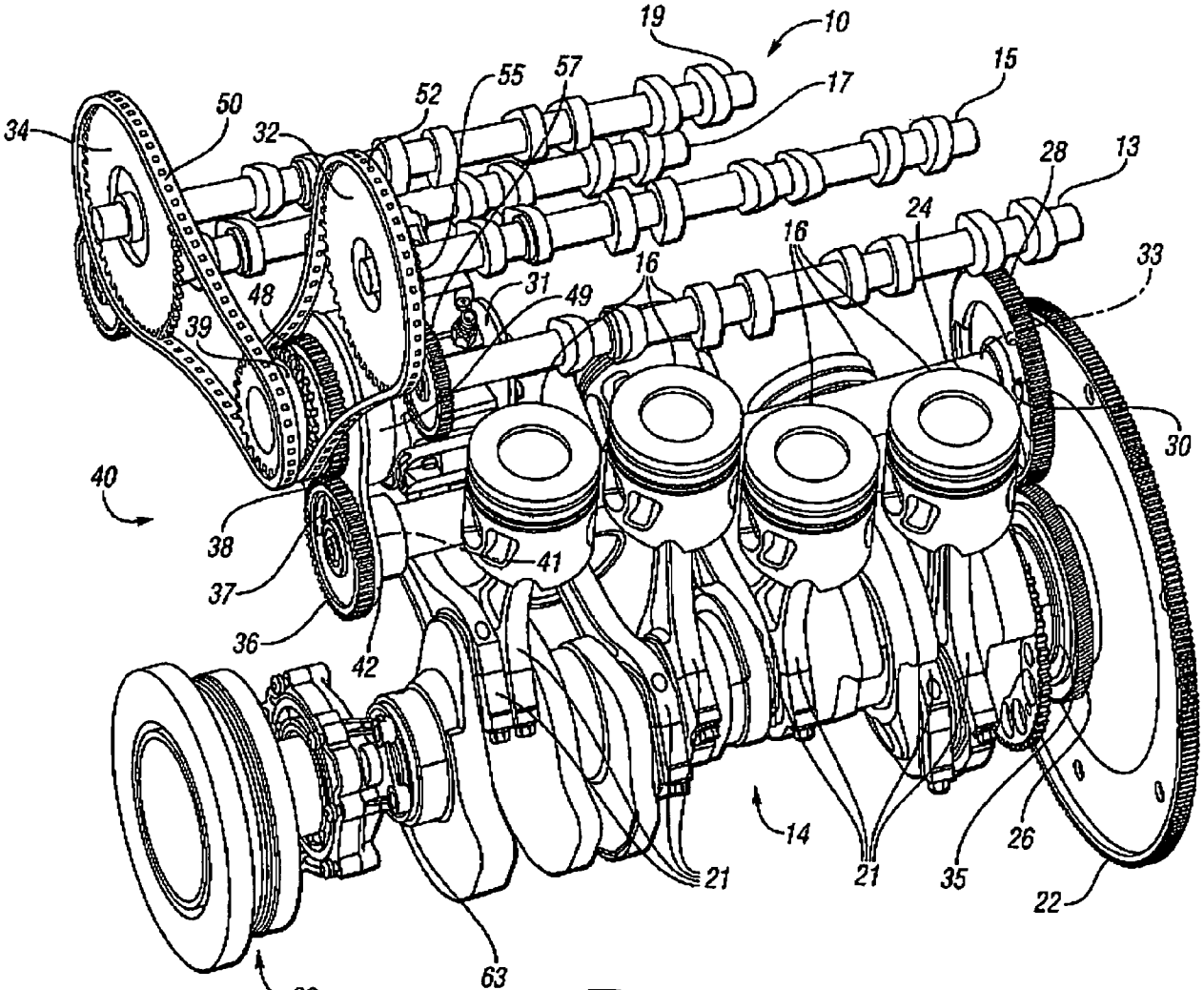
FIG. 1 is a schematic perspective illustration of an engine assembly including a camshaft drive system having a crankshaft and a balance shaft with camshafts and a hydraulic pump driven by the crankshaft through the balance shaft.
Figure 3:
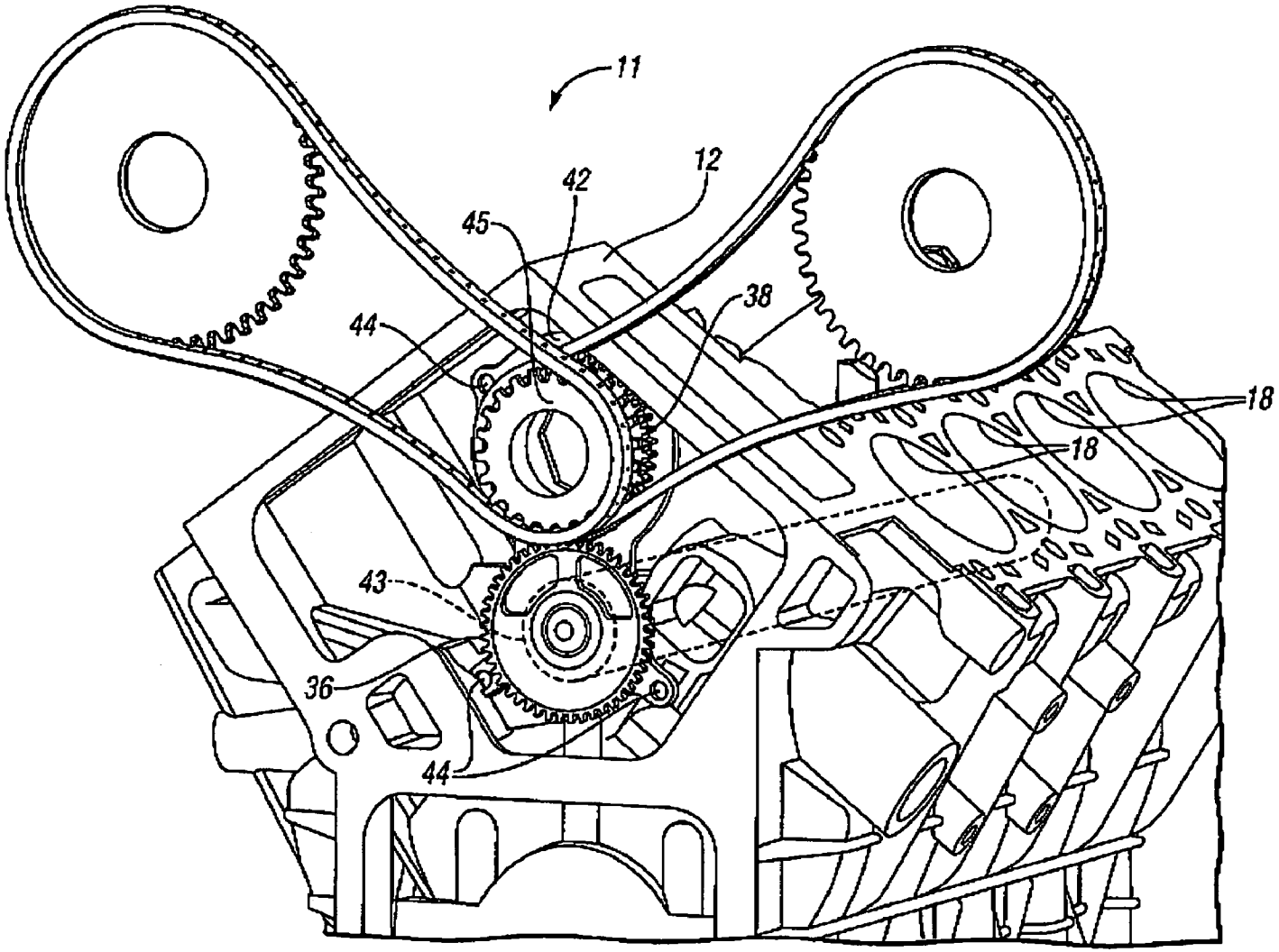
FIG. 3 is a schematic perspective illustration of the engine assembly and camshaft drive system of FIGS. 1 and 2 shown mounted to an engine block.

Referring to the drawings, wherein like reference numbers refer to like components, FIG. 1 shows selected components of a diesel engine 10 which is part of an engine assembly 11 (shown in FIG. 3). An engine block 12 (not shown in FIG. 1, but shown and described with respect to FIG. 3) houses many of the components. A crankshaft 14 is turned by movement of pistons 16 within cylinder bores 18 of the engine block 12 (as shown in FIG. 3), as is commonly understood. Periodic reciprocating movement of the pistons 16 causes torsional, lateral and vertical vibration forces upon the engine 10. The engine 10 is a dual overhead camshaft design with four rotating camshafts 13, 15, 17 and 19 that open and close valves (not shown) to allow intake and exhaust of the bores 18, as the pistons 16 are powered. Connecting rods 21 connected to the pistons 16 thereby cause rotation of the crankshaft 17, as is understood in the art. The camshafts 15 and 19 are referred to herein as first camshafts and camshafts 13 and 17 are referred to herein as second camshafts. Camshafts 13, 15 affect valves to control inlet and exhaust of bores 18 on one side of engine block 12, while camshafts 17 and 19 affect valves to control inlet and exhaust of bores on the other side of the engine block 12. A torsional damper 20 as well as a flywheel 22 operatively connected with the crankshaft 14 help to alleviate the torsional and lateral forces.

Figure 2:
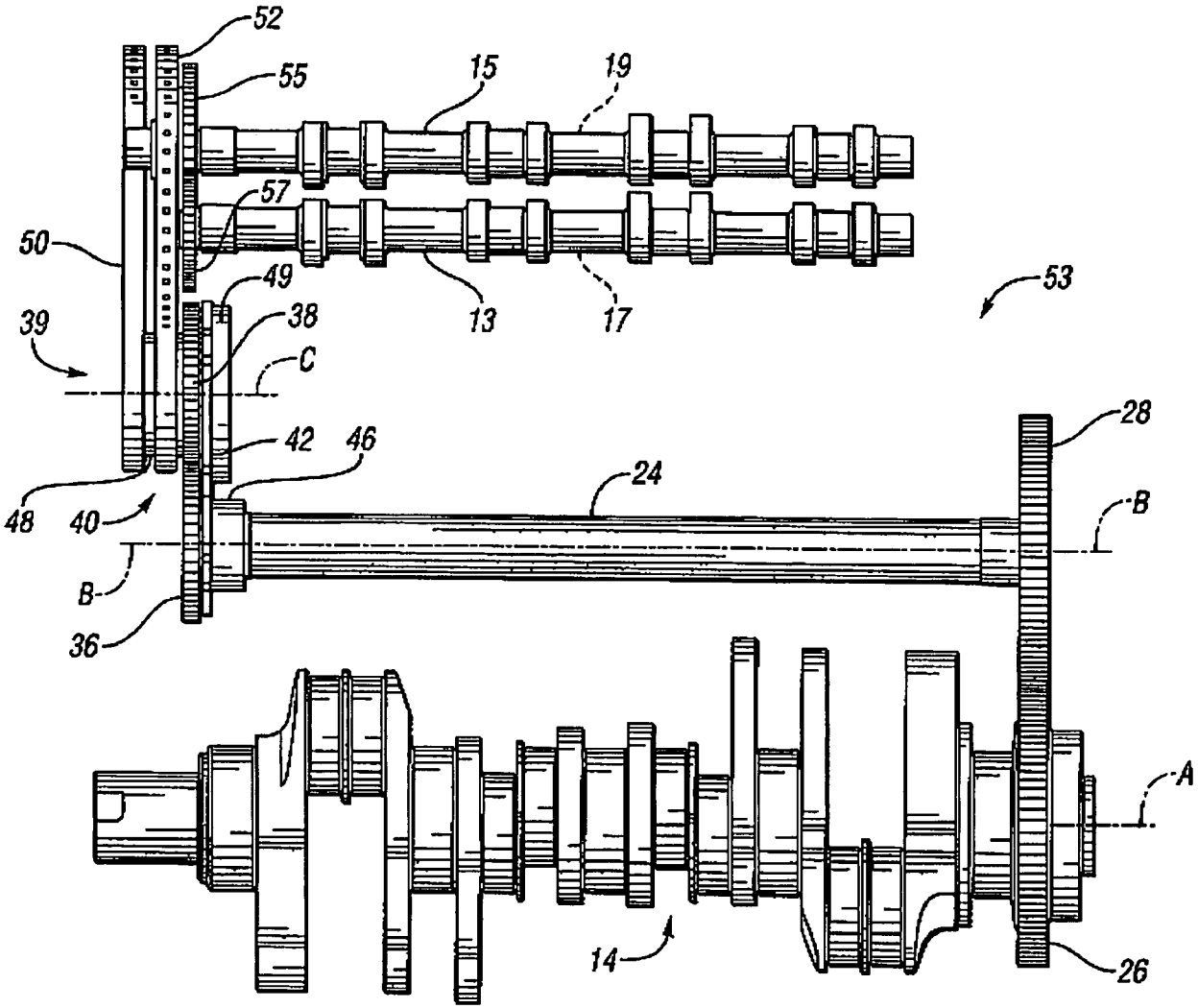
FIG. 2 is a side illustration of the engine assembly and camshaft drive system of FIG. 1.

A balance shaft 24 is radially-spaced and substantially parallel with an effective centerline A of the crankshaft 14 (centerline A shown in FIG. 2). The balance shaft 24 runs generally parallel with and is driven by the crankshaft 14. The balance shaft 24 counteracts engine vibration, such as vertical vibration forces caused by reciprocating movement of the pistons 16 and connecting rods 21 as well as by rotation of the crankshaft 14. The balance shaft 24 is also referred to herein as a rotatable drive member. A drive gear 26 is connected for common rotation with the crankshaft 14. The drive gear 26 intermeshes with and drives a weighted gear 28 connected at one end of the balance shaft 24. The drive gear 26 and weighted gear 28 may be referred to as a rear end gear set 26, 28. The weighted gear 28 preferably includes one or more openings 30 formed or cut in one half of the gear (the lower half as shown in FIG. 1) such that the weighted gear 28 creates an imbalance when rotated. The imbalance of the weighted gear 28 helps to counteract the engine vibrations.

Thus the crankshaft 14 and the balance shaft 24 are operatively connected via the rear end gear set 26, 28 such that rotation of the crankshaft 14 rotatably drives the balance shaft 24. As an alternative to the intermeshing rear end gear set 26, 28, sprockets, radially aligned and spaced from one another and interconnected via a chain or belt may be used to operatively connect the crankshaft 14 and the balance shaft 24. Such a connection would be similar to the connection of the camshafts 15 and 19 to the idler sprocket assembly 39 described below.

Referring to FIG. 2, the distance between the effective centerline A of the crankshaft and a centerline B of the balance shaft 24 is critical: any excess dimensional play between these centerlines will negatively affect "gear backlash", i.e., the dimensional tolerance or tightness of the intermeshing gears 26, 28. Less than optimal backlash (i.e., due to the centerlines A and B being too close to one another) could cause gear and bearing failure while excessive backlash (i.e., due to the centerlines A and B being too far apart) causes noise. Both the crankshaft 14 and the balance shaft 24 are supported by bearings (not shown) at bore openings at the rear of the engine block 12; controlling the location of these bore openings with respect to one another is critical as it determines the location of the centerlines A and B and hence backlash of the rear end gear set 26, 28.

Referring again to FIG. 1, in addition to counteracting engine vibration forces, the balance shaft 24 may be used to drive a variety of vehicle components, which may be included in vehicle accessories or systems. In this embodiment, the balance shaft 24 drives the first camshafts 15 and 19 via first and second overhead camshaft sprockets 32, 34, respectively, as well as a hydraulic fuel injection pump 31, as described below. Torque is transferred from the balance shaft 24 to these systems via a first gear 36 that intermeshes with a second gear 38. The second gear 38 is part of the idler sprocket assembly 39, which also includes a spindle 48, as described below. The first and second gears may be referred to as a front end gear set 36, 38. Thus, the first camshafts 15, 19 and the pump 31 are operatively connected to the balance shaft 24 via the front end gear set 36, 38. Alternatively, in lieu of the intermeshing gear set 36, 38, the first gear 36 may instead be a first sprocket and the second gear 38 may be replaced by sprockets formed on the idler sprocket assembly 39 which are connected to the sprockets of the first sprocket by a belt or chain.

Referring to the embodiment of FIG. 1, the first gear 36 is connected for common rotation with the balance shaft 24 and is formed with openings 37 such that it is weighted and creates a rotational imbalance, similar to weighted gear 28. The effective imbalance of the first gear 36 is radially opposed to the effective imbalance of the weighted gear 28.

Referring to FIG. 2, the idler sprocket assembly 39 includes the second gear 38 and spindle 48 which is connected for common rotation with the second gear 38. In this embodiment, the second gear 38 and spindle 48 are unitary and integrated; within the scope of the invention, they may also be separate components. First and second rotatable transfer devices, which in this embodiment are camshaft drive chains 50, 52, are connected between the spindle 48 and the first and second overhead camshaft gears 32, 34, respectively (shown in FIG. 1), to create a chain drive for transferring drive power from the spindle 48 to the camshafts 15, 19. Alternatively, gear teeth on the idler sprocket assembly 39 could directly intermesh with gear teeth of the camshafts 15, 19.

FIG. 2 illustrates a camshaft drive system 53 that includes the crankshaft 14, the balance shaft 24 and the first camshafts 15, 19. (In the side view of FIG. 2, first camshaft 19 is effectively obscured by fist camshaft 15 and camshaft 17 is effectively obscured by second camshaft 13.) The second camshaft 13 is rotatably powered by the first camshaft 15 via a first camshaft drive gear 55 that is connected concentrically with the first overhead camshaft sprocket 32 and intermeshes with a camshaft driven gear 57 that is connected concentrically with the camshaft 13. First camshaft 19 also has a camshaft drive gear that intermeshes with a camshaft driven gear on the second camshaft 17 in like manner so that the second camshaft 17 is rotatably powered by the first camshaft 19. Sprockets and chains may be used in lieu of intermeshing camshaft gears to transfer power from the first camshafts 15, 19 to the second camshafts 13, 17, respectively.

Because the crankshaft 14 drives the camshafts 13, 15, 17 and 19 through the balance shaft 24 via the rear end gear set 26, 28, rather than via a gear drive or sprockets and chain at the front of the crankshaft 14, space at the frond end of the crankshaft (near the torsional damper 20) is available for other uses.

Additionally, the hydraulic pump 31 is supported at an opening 45 (shown in FIG. 3) in the second gear 38 and is driven by rotation of the first gear 36. The pump 31 may be splined or otherwise secured for rotation with the second gear 38 and spindle 48.

Referring to FIG. 2, appropriate sizing of the rear end gear set 26, 28, the front end gear set 36, 38 and the overhead camshaft sprockets 32, 24 allows desired rotational speeds to be achieved. For example, the rear end gear set may be designed with a gear ratio of 1.0 so that the balance shaft 24 rotates at the same speed as the crankshaft 14 or with a gear ratio of 2.0 so that the balance shaft 24 rotates at twice the speed of the crankshaft 14. In either instance, the intermeshing gears 36, 38 may be sized to drive the hydraulic pump 31 at a desirable rotational speed while the camshaft sprockets 60, 62 (labeled in FIG. 5) may be sized to drive the camshafts 15, 19 at a desired one-half of crankshaft speed. If the hydraulic pump 31 is alternatively driven by gears intermeshing with the idler sprocket assembly 39 or by a sprocket connected for rotation with the idler sprocket assembly 39, it can be made to rotate at speeds different that the speed of the idler sprocket assembly 39.

Referring to FIG. 2, achieving optimal backlash of intermeshing first and second gears 36, 38 depends on controlling the relative location of a centerline C of the second gear 38 with respect to the centerline B of the first gear 36. (the centerline B of the first gear 36 is substantially the same as the centerline of the weighted gear 28 as both are substantially aligned with the balance shaft 24.) However, if in order to control backlash of the rear end gear set 26, 28, the balance shaft bore (43 in FIG. 3) through the engine block 12 for supporting the balance shaft 24 is machined from the rear of the engine block (i.e, the end near the rear end gear set 26, 28) the centerline accuracy of the front balance shaft bore opening (i.e., the opening at the end of the bore 43 near the front end gear set 36, 38 relative to other front end locations (such as the location of centerline C) may be compromise In order to solve the problem of ensuring accurate intermeshing of gear sets at both ends of the balance shaft 24, the first and second gears 36, 38 are preassembled as part of a drive plate assembly 40. The drive plate assembly 40 includes the first and second gears 36, 38 as well as a plate member 42. Bearings and bushings used to allow rotation of the gears 36, 38 with respect to the plate member 42 may also be included in the plate assembly 40. Specifically, the drive plate assembly 40 is preassembled by first mounting first and second gears 36, 38 to the plate member 42. The plate member 42 is then positioned at a front-end opening (indicated in phantom in FIG. 3) of the balance shaft bore 43 through the engine block 12. The plate member 42 is then mounted to the engine block 12. No separate opening in the engine block 12 is required at the front end for the second gear 38 (because the second gear 38 is secured to the plate member 42 rather than directly to the engine block 12); thus, centerline accuracy of the rear end of the shaft bore may be maintained without effect on backlash of the front end gear set 36, 38 relative to one another. The backlash of the front end gear set 36, 38 is controlled by the preassembled plate assembly 40, i.e., the mounting of the first and second gears 36, 38 to the plate member 42, and does not depend upon the location of the front end opening of the balance shaft bore 43. The engine assembly 11 of FIG. 3 includes the engine block 12, the balance shaft 24 (visible in FIGS. 1 and 2) and the drive plate assembly 40. It may also include a vehicle component such as the hydraulic pump 31 (visible in FIG. 1) and/or the first and second overhead camshaft sprockets 32, 24.

Figure 5:
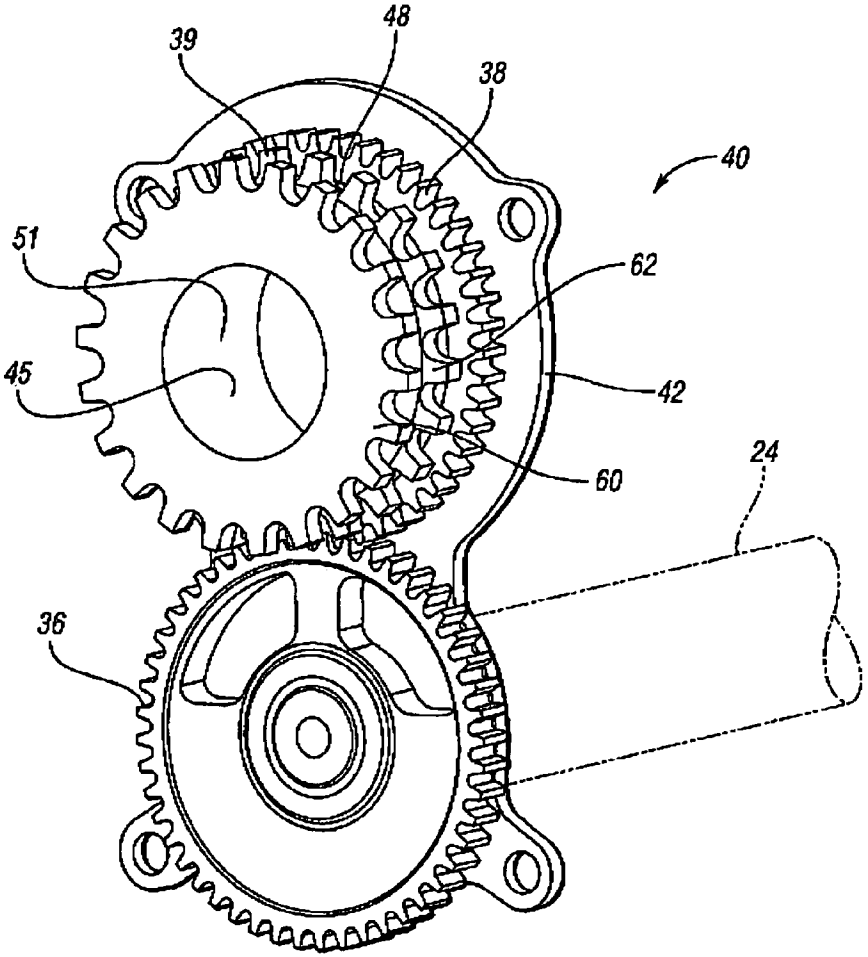
FIG. 5 is a schematic perspective illustration of a drive plate assembly of FIGS. 1 through 3 including the drive plate of FIG. 4, a front end gear set and an idler sprocket assembly.
Figure 4:
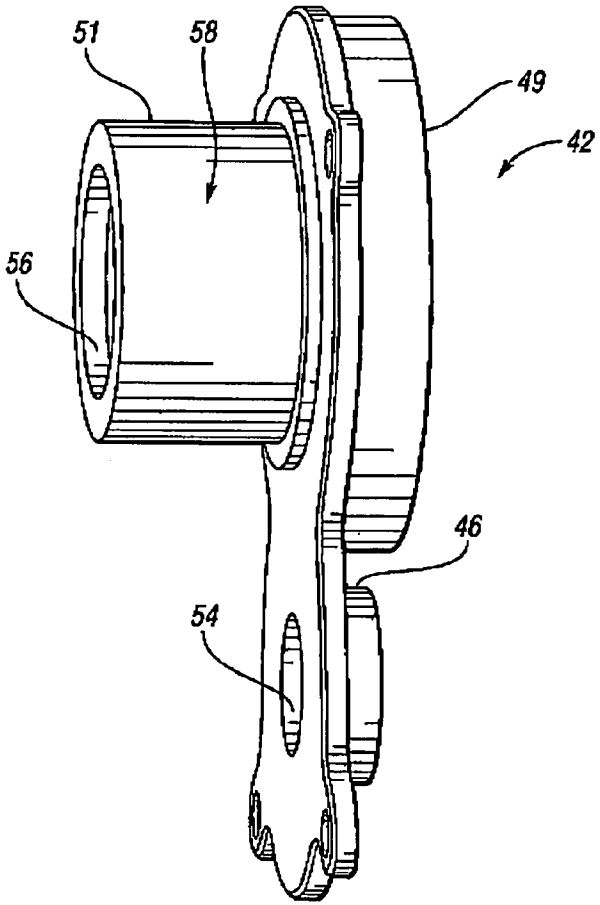
FIG. 4 is a schematic perspective illustration of a drive plate used in the engine assembly of FIGS. 1 through 3.

Referring to FIG. 3, the plate member 42 has fastener openings 44 formed or otherwise cut therein. (One fastener opening is obscured by the engine block 12 in FIG. 3, but is located symmetrically opposite the uppermost fastener opening 44 shown at the upper left of the plate member 42. The smaller image of the plate member 42 of FIG. 1 does not show the detail of the fastener openings 44; however, the fastener openings 44 exist in the plate member 42 as shown in FIGS. 3 through 5.) Threaded bolts (not shown) or other suitable fastening mechanisms may be received through the fastener openings 44 to secure the plate member 42 to the engine block 12. Referring again to FIG. 2, it is evident that the plate member 42 is formed with a first cylindrical flange portion 46. The flange portion 46 houses a bearing (not shown) to support the balance shaft 24 and the first gear 36 for common rotation with respect to the flange portion 46. A bushing (not shown) may be spaced between the cylindrical flange portion 46 and the front end opening of the balance shaft bore 43 (shown in FIG. 3). The end of the balance shaft 24 may be splined to mate with internal splines of the first gear 36. A bolt or other fastening device may secure the first gear 36 on the end of the balance shaft 24. The cylindrical flange portion 46 is piloted into the front-end opening of the balance shaft bore 43 (see FIG. 3) prior to fastening the plate member 42 to the engine block 12. The first gear 36 is concentric with the front-end opening of the balance shaft bore 43, and thus with the balance shaft 24 when the drive plate assembly 40 is secured to the engine block 12.

The plate member 42 has a cylindrical flange portion 49 to partially house and support the pump 31 at the second gear 38. In an alternative embodiment, the hydraulic pump 31 may be secured to the second gear 38 forward of the spindle 48. Additionally, the hydraulic pump 31 may instead be radially spaced from the spindle 48 and driven via a chain, similar to the overhead camshafts, in which event the cylindrical flange portion 49 would not be necessary.

The intermeshing gears 26, 28 forming the operative connection of the balance shaft 24 with the crankshaft 14 is at a rear end 33 of the balance shaft (rear end 33 is indicated in phantom because it is under the flange of the gear 28 in FIG. 1). The gear 26 is at a rear end 35 of the crankshaft 14. The intermeshing gears 36, 38 and the chains 50, 52 connecting the camshaft sprockets 32, 34 with spindle 48 of idler sprocket assembly 39 are operatively connected to the balance shaft 24 at a front end 41 of the balance shaft 24 opposite the rear end 33 (front end 41 is indicated in phantom because it is under the flange 46 of the plate member 42).

Referring to FIG. 4, the plate member 42 with first cylindrical flange portion 46 and second cylindrical flange portion 49 is depicted. A third cylindrical flange portion 51 extends opposite and concentric with the second cylindrical flange portion 49. A first opening 54 in the plate member 42 is concentric with and supports the balance shaft 24 and the first gear 36, as depicted in FIG. 1. A second opening 56 in the plate member 42 is concentric with the second gear 38 and spindle 48 shown in FIG. 2, which are supported for rotation about an outer surface 58 of the cylindrical flange portion 51.

Referring to FIG. 5, the drive plate assembly 40 includes plate member 42, first gear 36 and second gear 38. The desired backlash of the intermeshing first gear 36 and second gear 38 is controlled by the mounting of the gears 36, 38 to the plate member 42. First gear 36 is mounted to plate member 42 by sliding a flange extension of first gear 36 within the flange portion 46 at an opening of plate member 42 (the end of the flange extension of first gear 36 is visible extending through the flange portion 46 around balance shaft 24 in FIG. 2). A bearing may also be installed between the first gear 36 and the plate member 42. Second gear 38 is mounted to plate member 42 by sliding second gear 38 over a flange portion 51 that extends outward under the spindle 48 for supporting the spindle. A bearing may also be installed between the gear 38 and flange portion 51. The spindle 48 has first sprockets 60 for receiving the first chain 50 of FIG. 1 and second sprockets 62 for receiving the second chain 52 of FIG. 1. Alternatively, the spindle 48 could be formed with grooves instead of sprockets and another type rotatable transfer device, such as belts, could be fitted within the grooves for rotation with the spindle 48 for driving vehicle components such as camshaft sprockets 32, 34. Furthermore, the first and second sprockets 60, 62 could be replaced by gear teeth formed on the idler sprocket assembly 39 and the camshaft sprockets 32, 34 could be toothed gears sized and positioned to intermesh with the teeth on the idler sprocket assembly 39 such that idler sprocket assembly 39 is operatively connected to the camshafts 15, 19 via such intermeshing gears.

The front end gear set 36, 38 allows the balance shaft 24 to be utilized not only to balance vibrational forces in the engine 12, but also to drive other vehicle systems. Overhead camshafts 13, 15, 17 and 19, hydraulic pump 31 and a variety of other vehicle systems may be powered via rotation of the balance shaft and, ultimately, via the crankshaft 14. The existing rear end gear set 26, 28 between the crankshaft 14 and the balance shaft 24 is used in the camshaft drive system 53 to further provide rotational power to the camshafts 13, 15, 17 and 19. Packaging space near a front end 63 of the crankshaft 14 may thus be utilized for purposes other than driving the vehicle components.

While the best mode for carrying out the invention has been described in detail, those familiar with the art to which this invention relates will recognize various alternative designs and embodiments for practicing the invention within the scope of the appended claims.

The invention claimed is:

1. An engine assembly comprising:

an engine crankshaft;

a balance shaft operatively connected with said crankshaft and rotatably driven thereby;

a vehicle component operatively connected with said balance shaft such that said vehicle component is rotatably driven by said crankshaft through said balance shaft;

wherein said balance shaft is operatively connected with said crankshaft at one end and operatively connected with said vehicle component at an opposing end; and wherein said vehicle component is not coaxial with said balance shaft;

a rear end gear set including a drive gear connected for rotation with said crankshaft and a driven gear intermeshing with said drive gear and connected for rotation with said balance shaft;

a front end gear set including a first gear connected for rotation with said balance shaft and an idler gear intermeshing with said first gear; wherein said front end gear set is at said opposing end of said balance shaft and said rear end gear set is at said one end of said balance shaft; and wherein said vehicle component is driven by rotation of said idler gear.

2. The engine assembly of claim 1, wherein said vehicle component is a pump.

3. The engine assembly of claim 1, wherein said vehicle component is a camshaft.

4. The engine assembly of claim 1, further comprising:

an idler sprocket assembly rotatably powered by said balance shaft and operatively connected with said vehicle component such that said vehicle component is rotatably driven by said idler sprocket assembly; and wherein said vehicle component is operatively connected with said balance shaft via said idler sprocket assembly.

5. The engine assembly of claim 4, wherein said vehicle component is operatively connected with said idler sprocket assembly via a chain.

6. An engine assembly of claim 4, wherein said vehicle component is a first camshaft and further comprising:

a camshaft drive chain operatively connecting said idler sprocket assembly with said first camshaft.

7. The engine assembly of claim 6, further comprising:

a second camshaft rotatably driven by said first camshaft.

8. The engine assembly of claim 4, wherein said vehicle component is a hydraulic pump concentric with said idler sprocket assembly and connected for common rotation therewith.

9. A camshaft drive system comprising:

an engine crankshaft;

a balance shaft operatively connected with said crankshaft and rotatably driven thereby;

an overhead camshaft operatively connected with said balance shaft such that said camshaft is rotatably driven by said crankshaft through said balance shaft;

a rear end gear set including a drive gear connected for rotation with said crankshaft and a driven gear intermeshing with said drive gear and connected for rotation with said balance shaft;

a front end gear set including a first gear connected for rotation with said balance shaft and an idler gear intermeshing with said first gear and rotatably driven thereby; wherein said front end gear set is at one end of said balance shaft and said rear end gear set is at an opposite end of said balance shaft; and wherein said camshaft is driven by rotation of said idler gear.

10. The camshaft drive system of claim 9, wherein said balance shaft is substantially parallel with said crankshaft.

11. The camshaft drive system of claim 9, further comprising:

an idler sprocket assembly rotatably powered by said balance shaft and operatively connected with said camshaft such that said camshaft is rotatably driven by said idler sprocket assembly; and wherein said camshaft is operatively connected with said balance shaft via said idler sprocket assembly.

12. The camshaft drive system of claim 9, further comprising:

a pump operatively connected with said balance shaft such that said pump is rotatably driven by said crankshaft via said balance shaft.

13. A camshaft drive system comprising:

an engine crankshaft;

a balance shaft operatively connected in parallel with said crankshaft and rotatably driven thereby;

an overhead camshaft operatively connected with said balance shaft such that said camshaft is rotatably driven by said crankshaft through said balance shaft;

a hydraulic pump operatively connected with said balance shaft such that said pump is rotatably driven by said crankshaft via said balance shaft; and an idler sprocket assembly rotatably driven by said balance shaft; wherein said camshaft and said pump are operatively connected with said balance shaft via said idler sprocket assembly.

* * * * *